US006902012B2

(12) United States Patent
Kristen et al.

(10) Patent No.: US 6,902,012 B2
(45) Date of Patent: Jun. 7, 2005

(54) PERCUSSION ELECTRICAL HAND-HELD TOOL

(75) Inventors: Ferdinand Kristen, Gilching (DE); Hans-Werner Bongers-Ambrosius, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 379 days.

(21) Appl. No.: 09/846,931

(22) Filed: May 1, 2001

(65) Prior Publication Data

US 2001/0037889 A1 Nov. 8, 2001

(30) Foreign Application Priority Data

May 2, 2000 (DE) ..... 100 21 355

(51) Int. Cl.[7] ..... B65D 9/04; B65D 11/06

(52) U.S. Cl. ..... 173/200; 173/201; 173/128; 310/12; 310/36; 310/37; 310/47; 310/50

(58) Field of Search ..... 310/36, 37, 47, 310/50, 12; 173/201, 211, 128, 200, 162.1, 162.2, 210

(56) References Cited

U.S. PATENT DOCUMENTS 2,907,239 A * 10/1959 Schwenk ..... 81/52.3
3,203,490 A * 8/1965 McCarty ..... 173/109
3,305,031 A * 2/1967 Bez et al. ..... 173/115
4,456,076 A * 6/1984 Schmid et al. ..... 173/116
4,462,467 A * 7/1984 Weingartner ..... 173/105
4,905,772 A * 3/1990 Honsa et al. ..... 173/162.1
5,111,890 A * 5/1992 Ranger et al. ..... 173/104
5,706,902 A * 1/1998 Eisenhardt ..... 173/93.5
5,806,609 A 9/1998 Stock et al. ..... 173/205
5,848,655 A * 12/1998 Cooper et al. ..... 173/176
5,927,407 A 7/1999 Gwinn et al. ..... 173/162.2
6,089,330 A * 7/2000 Miescher et al. ..... 173/132
6,127,751 A * 10/2000 Kristen et al. ..... 310/50
6,320,286 B1 * 11/2001 Ramarathnam ..... 310/50
2003/0222516 A1 * 12/2003 Cleanthous et al.

OTHER PUBLICATIONS

"General Theory on Motors", http://mechatronics.mech.northwestern.edu/mechatronics/design_ref/actuators/motor_theory.*

* cited by examiner

*Primary Examiner*—Rinaldi I. Rada
*Assistant Examiner*—Gloria R. Weeks
(74) *Attorney, Agent, or Firm*—Sidley Austin Brown & Wood, LLP

(57) ABSTRACT

An electrical hand held tool for producing at least a percussion movement of a working tool includes an electrical drive, a first, oscillating subassembly including a percussion mechanism (2) and a rotor (5) of the electrical drive for transmitting torque to the percussion mechanism and rotatable about a rotor axis (B) extending parallel to an oscillation path (I) of the first subassembly, and a second subassembly including a housing (6) in which the first subassembly is supported for a limited oscillating movement along a tool axis (A).

8 Claims, 1 Drawing Sheet

PERCUSSION ELECTRICAL HAND-HELD TOOL

BACKGROUND OF THE INVENTION

1. Field of the Invention

The present invention relates to an electrical hand-held tool for producing at least a percussion movement, e.g., a hammer drill or chisel hammer with, preferably, a pneumatic percussion mechanism.

2. Description of the Prior Art

Electrical hand-held tools with a pneumatic percussion mechanism are used for generating percussions of a reciprocating oscillation movement which is transmitted to a gas spring arranged between a piston, which is sealingly displaceable in a hollow cylinder relative thereto, and an axially spaced for the piston, sealingly movable percussion means. A rotational movement of an electrical drive is transformed, at least partially, by a suitable transformation gear, primarily by an eccentric oscillator or a wobbling oscillator, in a reciprocating movement of the piston. With a correct use, a counterforce, which acts in the axial direction of the tool, acts, in the path of application of a force (force path), as a reaction percussion or impact via the working tool, the percussion mechanism, the transformation gear and its support on the tool causes application of disturbing vibration to a person who applies the force to the tool.

From the physics of constrained amplitude oscillations of a suspended pendulum, it is basically known that it is possible to effectively dampen particularly high oscillation amplitudes in case of resonance or reverse the oscillation amplitudes by widely spaced from each other, resonant and oscillation frequencies. With the resonant or natural frequency of the suspended pendulum, the oscillating mass and the spring constant which, with a simple percussion, electrical hand-held tool, are defined by the tool mass and the spring constant of the user when the user operates the tool, are dampened. Therefore, a certain oscillation amplitude of the percussion, electrical hand-held tool is determined dependent on the number of percussions that defines the oscillation frequency.

U.S. Pat. No. 3,918,535 discloses arrangement of a preloaded compression spring in the force path between the axially displaceable percussion mechanism and the housing in order to increase the spacing between the operating points. The spring partially oscillatingly decouples the first axially displaceable subassembly, which includes the percussion mechanism, from the second subassembly which includes the housing. Thereby, the relative movement of the first subassembly with respect to the housing, which is caused by the partial oscillating separation of the first and second subassemblies, can be dampen by using a damping element. The resulting system of two decoupled, acting in the same direction, oscillators contains a relatively small mass of the first subassembly, which includes the percussion mechanism, and it is the first subassembly that is subjected to strong oscillations as a result of the recoil of the percussion. The relatively large mass of the second subassembly, which includes the housing, is subjected, dependent on its resonant frequency, only to constrained oscillations with a small oscillation amplitude.

The damping of the recoil energy by a relative movement of the second subassembly using a damping element depends basically on the dissipated portion of the deformation energy of the damping element. The recoil energy damping increases with the increase of the deformation force amplitude and the deformation path amplitude.

U.S. Pat. No. 5,927,407 discloses the use of six elastomeric components for reducing the oscillations of oscillatingly decoupled subassemblies of a hand-held tool. The elastomeric components act in the axial direction, and their viscous elastic energy dissipation is optimized in accordance with the oscillation frequency. The foregoing solution permits to reduce the oscillation amplitude only relatively to the case when a damping element is used.

Accordingly, an object of the present invention is to provide a percussion, electrical hand-held tool having reduced vibrations in comparison with the conventional tools.

Another object of the present invention is to provide a substantially wear-free driving chain between two, movable relatively to each other, vibration decoupled, subassemblies of a percussion, electrical hand-held tool.

SUMMARY OF THE INVENTION

These and other objects of the present invention, which will become apparent hereinafter, are achieved by providing an electrical hand-held tool for producing at least a percussion movement of a working tool and including an electrical drive, a first subassembly including a percussion mechanism and a rotor of the electrical drive rotatable about a rotor axis extending parallel to an oscillation path of the first subassembly, and a second subassembly including a housing in which the first subassembly is supported for a limited movement along a tool axis.

Thus, the first subassembly includes, in addition to the percussion mechanism, the rotor of the electrical drive which rotates about a rotor axis extending parallel to the oscillation path of the first subassembly, and the second subassembly includes the stator of the electrical drive and the housing. Advantageously, the first subassembly includes the transformation gear which transforms the rotational movement of the rotor in the reciprocating movement of the percussion mechanism.

As a result of incorporation of the rotor and the transformation gear into the first subassembly, in addition to the percussion mechanism, the oscillating mass of the first subassembly increases with respect to the mass of the second subassembly which includes the stator, the housing and the electrical drive electronics. The absolute increase of the mass of the first subassembly results in reduction of the oscillation amplitude of the first subassembly which is determined by the recoil energy.

The mass ratio of the two subassemblies is shifted toward the first subassembly so that, finally, the two subassemblies have substantially the same mass. As a result, the damping element, which is provided between the two subassemblies, can dissipate more recoil energy, which reduces the oscillation amplitude of the second subassembly that includes the housing.

Advantageously, the damping element is formed of a viscous elastic material which dissipates a large amount energy at the oscillation frequency in the range of the operational temperatures of a percussion hand-held tool.

The driving chain for generating the percussions and/or rotational movement of the electrical hand-held tool has substantially wear-free coupling means which provide for the relative movement. The coupling means is formed as a torque spanner coupling, with a magnetic rotary field of the stator acting on the axially displaceable, brushless rotor. In particular, mechanical force-transmitting and, therefore, wear-susceptible coupling for compensation of the relative movement between the two subassemblies becomes unnecessary. With the use of the collectorless rotor, the collectors, which are susceptible to wear during the axial movement, are also eliminated.

The novel features of the present invention, which are considered as characteristic for the invention, are set forth in the appended claims. The invention itself, however, both as to its construction and its of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows a side, partially cross-sectional view of a percussion, electrical hand-held tool according to the present invention.

DETAILED DESCRIPTION OF THE PREFERRED EMBODIMENT

Figure 1:
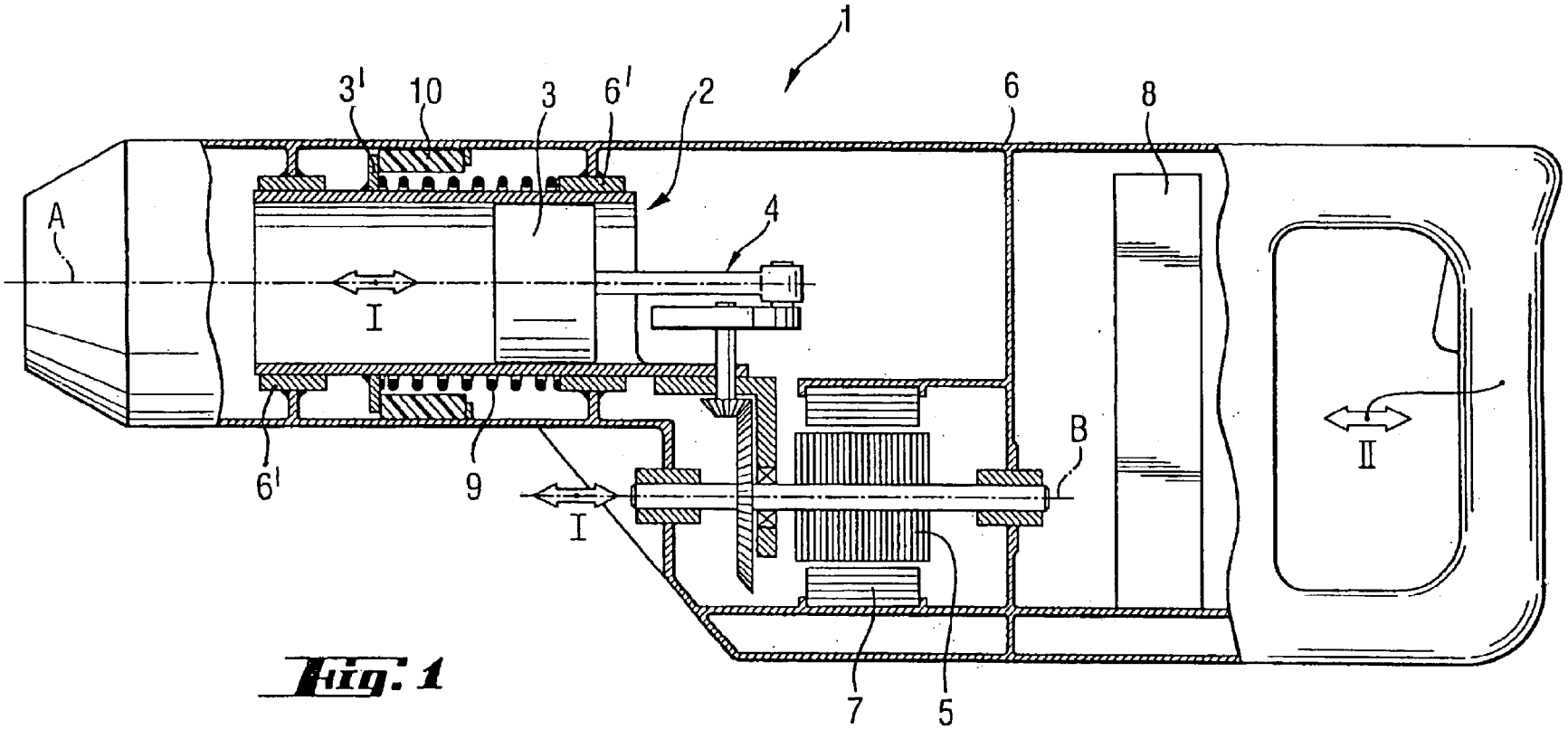

A percussion, electrical hand-held tool 1 according to the present invention, which is shown in the drawing, includes a first subassembly with a percussion mechanism 2. The first subassembly is supported for a limited displacement along the tool axis A, e.g., 10 mm, by, e.g., spaced slide or roller bearings 6' fixed, secured in the housing 6. The percussion mechanism 2 includes a reciprocating piston 3 and a transformation gear 4 including an eccentric and two conical gears engaging each other at a right angle. The tool 1 further includes a brushless rotor 5 of an electrical drive with one of the conical gear being secured thereon. The rotor 5 rotates about the rotor axis B and is supported for a limited axial displacement along the axis B parallel to a first oscillation path I of displacement of the first subassembly, and is displaceable, together with the first subassembly the axis B. Still further, the tool 1 includes a second subassembly displaceable along the second oscillation path II. The second subassembly includes the housing 6, a stator 7 of the electrical drive, and an associated control electronics 8 for the electrical drive. The second subassembly is protected from vibrations, which take place along the oscillation paths I–II, with respect to the first subassembly by a preloaded spring 9, e.g., a helical compression spring and by a damping element 10 which extends parallel to the spring 9 and is made of a viscous elastic material. The spring 9 extends between a flange 3' provided on the piston 3 and the rear bearing 6' of the bearings which support the first subassembly for the limitation axial displacement.

Though the present invention was shown and described with references to the preferred embodiment, such is merely illustrative of the present invention and is not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. An electrical hand-held tool for producing at least a percussion movement of a working tool, comprising an electric drive; a first, oscillating subassembly including a percussion mechanism (2) for transmitting the percussion movement to the working tool, and a brushless rotor (5) of the electrical drive which is rotatable about a rotor axis (B) extending parallel to an oscillation path (I) of the first subassembly wherein the brushless rotor (5) also oscillates along the rotor axis; and a second subassembly including a stator (7) of the electrical drive and a housing (6) in which the first subassembly is supported for a limited oscillating movement along a tool axis (A) and relative to the second sub-assembly.

2. An electrical hand-held tool according to claim 1, wherein the first subassembly includes a transformation gear.

3. An electrical hand-held tool according to claim 1, wherein the second subassembly includes control electronics (8) for the electrical drive.

4. An electrical hand-held tool according to claim 1, further comprising elastic spring means (9) for providing a vibration decoupling connection of the first subassembly with the second subassembly.

5. An electrical hand-held tool according to claim 1, further comprising a damping element (10) arranged parallel to the spring means (9).

6. An electrical hand-held tool according to claim 5, wherein the damping element is formed of a viscous elastic material.

7. An electrical hand-held tool according to claim 6, wherein the viscous elastic material has an optimal energy dissipation at an operation temperature and at an oscillation frequency of the hand-held tool.

8. An electrical hand-held tool according to claim 7, wherein the viscous elastic material has an optimal energy dissipation at an operation temperature and at an oscillation frequency of the hand-held tool.

* * * * *